US005897744A

United States Patent [19]

Hamunen et al.

[11] Patent Number: 5,897,744

[45] Date of Patent: Apr. 27, 1999

[54] METHOD FOR CONTROLLING SPECK DEFECTS IN RECYCLING PAPER PRODUCT

[75] Inventors: Antti Hamunen; Kari Nurmi, both of Raisio; Jens-Mikael Gottberg, Turku, all of Finland

[73] Assignee: Raisio Chemicals Oy, Raisio, Finland

[21] Appl. No.: 08/632,397

[22] PCT Filed: Sep. 30, 1994

[86] PCT No.: PCT/FI94/00438

§ 371 Date: Apr. 19, 1996

§ 102(e) Date: Apr. 19, 1996

[87] PCT Pub. No.: WO95/13426

PCT Pub. Date: May 18, 1995

[30] Foreign Application Priority Data

Nov. 12, 1993 [FI] Finland ..... 935028

[51] Int. Cl.[6] ..... D21H 23/06; D21H 17/29

[52] U.S. Cl. ..... 162/12; 162/184; 162/263

[58] Field of Search ..... 162/5, 12, 135, 162/184, 263

[56] References Cited

U.S. PATENT DOCUMENTS 4,872,951 10/1989 Maliczyszyn et al. ..... 162/135

FOREIGN PATENT DOCUMENTS 0 350 668 A2 of 1990 European Pat. Off. .
0 350 668 A3 of 1990 European Pat. Off. .
WO 93/10305 of 1993 WIPO .

*Primary Examiner*—Stanley S. Silverman
*Assistant Examiner*—Dean T. Nguyen
*Attorney, Agent, or Firm*—Pollock, Vande Sande & Priddy

[57] ABSTRACT

The present invention is related to a method of manufacturing a paper product containing anionic laminating, coating or sizing agents, said paper product being free from carry-over speck defects in recycle use. The method is characterized in that a cationic compound is added to the paper web after the formation of the web.

7 Claims, No Drawings

METHOD FOR CONTROLLING SPECK DEFECTS IN RECYCLING PAPER PRODUCT

FIELD OF THE INVENTION

The present invention relates to a method of manufacturing a paper product containing anionic laminating, coating or sizing agents, said paper product being free from carry-over speck defects in recycle use.

Most paper grades and converted paper products contain plenty of anionic compounds partly stemming from the own extractives of pulp wood and partly from chemicals used in paper manufacture. When the fiber material of paper is reused in broke recycling or repulping of recycle paper, the anionic components tend to become dissolved or dispersed in factory circulation waters. As a result, the dispersed anionic trash material tend to adhere on the paper-manufacturing equipment, wires, drying felts and cylinders, etc., whereby problems arise in the form of reduced production capacity, shutdowns and degradation of product quality. The extent of the trash material problem is in linear proportion to the amount of anionic components in the paper products being recycled. A particularly tough problem in this respect is formed by, e.g., coated print paper grades in which the coats contain abundant amounts of anionic binders such as carboxylated latexes, for instance. Still larger trash material problems are incurred by converted paper grades coated with anionic compounds such as barriers to transmission of moisture vapour or gases, for instance. Also different dispersion, self-adhesive and hot-melt types of adhesives cause problems through accumulation of such trash materials in paper recycling.

A method used in an increasing extent to control the problems caused by trash materials comprises adding such cationic, conventionally polymeric, trash control agents to the paper-making process that are capable of fixing the anionic trash materials to the pulped fibers. The cationic agent is then added to the water-suspended pulp at a suitable point along the paper-making line.

These actions of rectifying the trash material problems which are performed-at the formation end, that is, wet end, of the paper-making process are a most useful solution to the end of locally overcoming the problem situations caused by, e.g., repulping of the broke originating from the plant. With the continuously tightening requirements for increased degree of paper recycling, this approach, however, represents no universally applicable nor sufficient solution; namely, defibering (repulping) facilities must be available for recyclable fiber material irrespective of whether the plant performing the repulping of the recycle fiber has the provision of using an anionic trash control agent at an early stage of the paper-making process or not.

SUMMARY OF INVENTION

It is an object of the present invention to provide a universal solution to the above-described problem. The method according to the invention is based on neutralizing the anionic net charge with a cationic compound so that said cationic compound is added to the ready-formed web after the formation of the web. Then, the product entering the market contains an internal trash control treatment, thus relieving the defibering plant from any trash material control problems imposed by the product.

Accordingly, the present invention comprises the addition of a cationic compound to the web. The application of the compound can be made in a plurality of alternative points along the process line: by spraying the compound to the formed web travelling on the wire or drying felts, applying the compound to the web after the dryer section of the paper machine prior to the application of the coating and sizing furnishes which increase the anionic load (such as, i.e., pigment coating or barrier coating with an anionic dispersion furnish), or alternatively, after the coating and surface treatment steps.

BEST AND VARIOUS EMBODIMENTS FOR CARRYING OUT INVENTION

As regards to the intended function of the invention (that is, recyclability of the paper product), no major difference exists on which side of the web the cationic compound will be applied or whether said compound will possibly be applied symmetrically on both sides of the web; in fact, the most advantageous method and point of application are dictated by the machine construction available and other desired properties required from the paper quality. For instance, if a converted paper product is desired to be produced having a one-sided coated base web, the preferred application method of the cationic compound may be on the uncoated side of the base web. Simultaneously, the curling of the paper product may be prevented. When a printing paper grade is to be manufactured, the cationic treatment is appropriately applied on both sides of the web to assure equal printability on both sides. (From studies published on cationic coating pastes can be inferred that cationic constituents have an advantageous impact on, i.a., the opacity, printability and strength properties of coated printing paper.)

The advantageous addition level of the cationic compound must be metered so that the net charge of the ready-made product will be close to neutral The greater the amount of anionic components- in the base web, the higher must be addition level of the applied cationic compound. The optimum addition level can be determined through, e.g., colloidal titration by first disintegrating the web sample in a laboratory-scale pulper and then performing the titration of the filtered aqueous phase with either an anionic or cationic reagent depending on the initial net charge of the web sample. In practice using commercially available cationic polymer compounds, the advantageous addition level of the cationic compound varies in the range 0.01–1.0 wt-% of dry cationic compound relative to the weight of the paper web, depending on the net anion content of the paper product.

The application of the cationic compound on the paper web may occur using various application methods including, i.a., spraying onto the web, coating by means of a doctor blade, air brush, film transfer application from an applicator roll or glue press roll.

In the method of the invention, the cationic compound used is advantageously a cationic polymer. Particularly useful are such cationic polymers in which the cationic group is formed by functional groups stemming from a quaternary ammonium compound. A benefit of these cationic polymers is that their cationic function remains almost constant irrespective of the pH range of the application target (herein it must be noted that the method of the invention can also be implemented using, i.a., cationic polymers of the polyamide, polyimide, polyimine and other types such as those based on tertiary ammonium compounds provided that pH is adjusted to a suitable level for the use of these polymers during the recycling phase of the fibers). Commercially available cationic polymers containing a quaternary ammonium group are, i.a., polydiallyldimethyl ammonium chloride (poly-DADMAC) and polymers in which the cationic character is achieved by an epoxypropyltrialkyl ammonium salt, or its derivative, formed in the reaction of epichlorohydrine with trialkylammonium chloride. Examples of such cationic polymers are cationic dispersions in which one of the polymerizing components is an ester of methacryl acid and epoxypropyltrimethyl ammonium chloride, or alternatively, a carbohydrate derivative of a high degree of substitution with epoxypropyltrimethyl ammonium chloride. To achieve a low addition level, the cationic net charge in the polymer employed must be as high as possible. The function of the method according to the invention is elucidated in greater detail by reference to the following application examples.

EXAMPLE 1

Paper web (basis weight 80 g/m$^2$) manufactured from un-bleached pulp was first precoated with a coating paste containing 100 parts of kaolin, 5 parts of anionic oxidized potato starch and 7 parts of styrenebutadiene latex. The weight of this pigment coat was 13 g/m$^2$. As a moisture vapour barrier onto the pigment coat was applied a 10 g/m$^2$ coating of barrier dispersion containing carboxylated styrenebutadiene and starch copolymers and anionic dispersed wax hydrocarbons (for preparation thereof, refer to patent application FI 915,541). Next, a series of paper test samples were prepared having their uncoated side treated with different amounts of applied strongly cationic starch derivative (oxidized starch cationated with 2,3-epoxytrimethyl ammonium chloride up to a degree of substitution of 0.7, nitrogen content 3.7 %). For test data, refer to Table 1. Application was performed by spraying an aqueous solution of the cationic polymer onto the uncoated side of the paper web. Subsequently, the paper web was dried.

45 g of the treated paper was shredded into small pieces and mixed with 955 g of water. The mixture was heated to 45° C. and subsequently disintegrated in a laboratory-scale Vollrath pulper for 30 min using a blade speed of 3000 r/min. The pulp was filtered on a 150 $\mu$m mesh wire and the filtrate water was measured for opacity (turbidity), chemical oxygen demand and net charge.

The filtrate of sample 1 was milky whitish, opaque and dispersion-like. With an increasing addition level of the cationic polymer, the filtrate became transparent, opalescent in sample 2 and finally colourless, fully clear in sample 4. The change of look in the filtrate waters and the results obtained from sample measurements indicate that the cationic polymer was capable of binding the dispersed trash materials to the repulped fiber. Laboratory hand-sheets were made from the defibered pulp by means of a hand mould. No essential visual differences were found by mutual evaluation of the handsheets made from pulp containing fiber obtained recycled coated paper raw material.

Table 1

Comparison of trash material load characterizing values for different addition levels of the cationic polymer, measured from the white water of the wire after repulping. Sample 1 is a comparative sample untreated with cationic polymer; Sample 5 is pure base web not subjected to coating with the anionic load increasing coating pigments

| Web sample | Cationic polymer addition [%] | Turbidity [FTU] | COD [mg/l] | Net charge [mmol/l] |
|---|---|---|---|---|
| #1 | 0.0 | 1968 | 626 | −0.475 |
| #2 | 0.2 | 804 | 465 | −0.266 |
| #3 | 0.4 | 103 | 304 | −0.120 |
| #4 | 0.6 | 61 | 300 | −0.066 |
| #5 | 0.0 | 30 | 130 | −0.136 |

Cationic polymer addition—amount of cationic polymer added as per cent of web basis weight Turbidity—measured in FTU units from the white water of the wire using Dr. Lange's cuvette method COD—Chemical Oxygen Demand in mg/l measured using Dr. Lange's cuvette method Net charge—measured from the white water of the wire by titration with potassium polyvinylsulfonate solution (using Mytek equipment). Negative sign indicates anionic net charge of sample.

EXAMPLE 2

Unbleached base web (basis weight 80 g/m$^2$) was sprayed with aqueous solution of poly-DADMAC and the paper handsheets were allowed to dry. That side of the handsheets which was spray-treated with the cationic polymer was coated with a 10 g/m$^2$ weight of the barrier dispersion described in Example 1 above using laboratory-scale Endupapp applicator apparatus. The handsheets were repulped in the manner described in Example 1. The measurement results for the wire white waters are given in Table 2. Wire white waters obtained from samples 3 and 4 were fully clear under visual observation.

TABLE 2

| Web sample | Coat weight [g/m$^2$] | Cationic polymer addition [%] | Turbidity [FTU] | COD [mg/l] | Net charge [mmol/l] |
|---|---|---|---|---|---|
| #1 | 10.8 | 0.00 | 1712 | 587 | −0.437 |
| #2 | 10.3 | 0.15 | 712 | 412 | −0.233 |
| #3 | 10.5 | 0.30 | 88 | 266 | −0.109 |
| #4 | 10.2 | 0.50 | 52 | 213 | −0.072 |
| #5 | 0.0 | 0.00 | 38 | 145 | −0.121 |

Coat weight - applied coat weight of anionic coat dispersion (g/m$^2$).

EXAMPLE 3

Groundwood-containing bleached base web (40 g/m$^2$) was coated with a coating paste having the following solids composition 100 parts of kaolin, 11 parts of styrene-butadiene latex and 0.6 parts of carboxymethyl cellulose. The coat was applied to both sides of the base web by a coat weight of 9 g/m$^2$. Next, to both sides of the coated handsheet was applied aqueous solution of the cationic, starch-based polymer described in Example 1 so that the amount of applied cationic polymer was finally 0.1% of the sheet base weight. The handsheet was allowed to dry, after which it was repulped in the same manner described in Example 1. Measurement results for the sample and a comparative sample not treated with the cationic compound are given in the table below.

TABLE 3

| Web sample | Coat weight [g/m$^2$] | Cationic polymer addition [%] | Turbidity [FTU] | COD [mg/l] | Net charge [mmol/l] |
|---|---|---|---|---|---|
| Comparative | 0.0 | 0.00 | 398 | 310 | −0.245 |
| Treated | 18.2 | 0.10 | 43 | 114 | −0.061 |

Wire white water for the sample treated with the cationic polymer was fully clear under visual observation.

We claim:

1. In a method for manufacturing a ready-made paper product containing anionic laminating, coating or sizing agents which comprises the steps of forming a cellulosic fiber web, and treating the fiber web to form a paper product containing anionic laminating, coating or sizing agents, wherein the improvements comprises the steps of (a) obtaining a sample of the paper product containing anionic laminating, coating or sizing agents, (b) disintegrating the sample to form a slurry, (c) filtering the slurry to produce a filtrate, (d) performing a colloidal titration on the filtrate to determine the anionic charge state of the paper product, and (e) adding an amount of a strongly cationic compound to the web sufficient to compensate said anionic charge and to provide a net charge of said ready-made paper product close to neutral, wherein said paper product being free from carry-over speck defects in recycle use.

2. A method as defined in claim 1, wherein said cationic compound is added to the uncoated side of the web coated only one-sidedly with an anionic laminating, coating or sizing agent, either prior to the application of said anionic agent or thereafter.

3. A method as defined in claim 1, wherein said cationic compound is added to the web prior to the application of said anionic laminating, coating or sizing agent.

4. A method as defined in claim 1, wherein said cationic compound is added to the web onto the anionic laminating, coating or sizing agent after the application of said anionic agent.

5. A method as defined in claim 1, wherein said cationic compound is added by means of spraying, a doctor blade, film transfer application from an applicator roll, a glue press roll or an air brush.

6. A method as defined in claim 1, wherein said cationic compound is a cationic polymer.

7. A method as defined in claim 6, wherein the cationic character of said cationic polymer is rendered by a quaternary ammonium compound.

* * * * *